United States Patent [19]

Bennett

[11] 4,273,643

[45] Jun. 16, 1981

[54] PROCESS FOR PRODUCTION OF SYNTHETIC CRUDE OIL, ALCOHOLS, AND CHARS DURING LOW TEMPERATURE CARBONIZATION OF COALS

[75] Inventor: Harold L. Bennett, Upper Marlboro, Md.

[73] Assignee: Bennett Engineering Inc., Camp Springs, Md.

[21] Appl. No.: 80,293

[22] Filed: Oct. 1, 1979

[51] Int. Cl.[3] ..... C10G 1/00; C10G 1/06; C10B 57/00; B09B 3/00

[52] U.S. Cl. ..... 208/8 R; 208/10; 201/17; 201/21; 201/2.5; 518/715; 518/717; 518/728

[58] Field of Search ..... 201/17, 21, 2.5; 260/449 R, 449.5; 208/8 R, 10

[56] References Cited

U.S. PATENT DOCUMENTS

| | | | |
|---|---|---|---|
| 2,238,367 | 4/1941 | Mohr et al. | 201/21 X |
| 3,576,734 | 4/1971 | Bennett | 208/8 |
| 3,909,364 | 9/1975 | Singh | 201/2.5 |
| 3,970,524 | 7/1976 | Funk | 201/2.5 |
| 4,011,275 | 3/1977 | Zohner | 260/449 R X |
| 4,076,612 | 2/1978 | Hollaway | 260/449 R X |
| 4,096,163 | 6/1978 | Chang et al. | 260/449 R |
| 4,101,416 | 7/1978 | Dolbear | 208/8 R |
| 4,138,442 | 2/1979 | Chang et al. | 260/449.5 |

*Primary Examiner*—Delbert E. Gantz
*Assistant Examiner*—William G. Wright
*Attorney, Agent, or Firm*—Gerald J. Ferguson, Jr.; Joseph J. Baker

[57] ABSTRACT

A process for the production of synthetic crude oil, alcohols, semi-coke (chars), and cokes which are obtained during the production of low temperature coal tars and are derived by careful temperature control during the carbonization of various carbon containing material such as bituminous coals, peat, lignite, trash, and other solid wastes.

12 Claims, No Drawings

PROCESS FOR PRODUCTION OF SYNTHETIC CRUDE OIL, ALCOHOLS, AND CHARS DURING LOW TEMPERATURE CARBONIZATION OF COALS

BACKGROUND OF THE INVENTION

This invention relates to an improved process for the economical production of synthetic crude oil and alcohol. The synthetic crude oil is obtained from low temperature coal tars which have been obtained by carefully controlling the temperature during the carbonization of various cool materials such as coal, peat, lignite, trash and solid waste. The alcohol is obtained during the process by synthesizing the gases evolved during the process under controlled conditions of heat and pressure.

As described in my earlier U.S. Pat. No. 3,576,734, the synthetic crude oil and accompanying gaseous products are obtained by introducing heated low temperature tars with hydrogen into an insulated drum containing a suitable catalyst comprised of one or more of the following elements: cobalt, molybdenum or nickel. The residence time of the combined heated low temperature tars and hydrogen in the presence of the catalyst is sufficient to produce a petroleum-like synthetic crude oil. A batch or continuous type process may be used to accomplish the formation of an expanded "high type" synthetic crude oil. This expanded high grade synthetic crude oil from which most of the sulfur has been removed during the process contains a large percentage of naphtha and is ready for further processing. Following removal of the naphtha fractions by methods well known in the art, the bottoms or remainder of the synthetic crude oil can be introduced and recycled into the low temperature tars entering the system.

The synthetic crude oil formed by the process of the present invention can be refined by any of the processes well known in the petroleum industry. End products, after refining, depending on the variation of heat, pressure and time that the low temperature tars and hydrogen are in contact with the catalyst will contain high precentages of aromatic hydrocarbons, amines, phenols, paraffins, olefins and various other light end materials. Gaseous products formed will contain hydrogen, light end gases, nitrogen compounds, and hydrogen sulfide, all of which can be processed into marketable products.

SUMMARY OF THE INVENTION

According to the present invention, the process described in my earlier U.S. Pat. No. 3,576,734 is improved to produce alcohol as well as synthetic crude oil. This is accomplished by oxidizing the gases evolved during the process to produce heat and then synthesizing in the presence of a catalyst into oil and alcohol. The gases may also be separated and developed into products in a light ends plant normal to the system. The char semicoke derived as a result of the low temperature carbonization process can be treated to remove the sulfur as hydrogen sulfide gas, etc., cooled and sold as product, or further heated to produce additional gases and coke, or treated with steam to produce water gas.

DESCRIPTION OF THE PREFERRED EMBODIMENT

In the practice of the present invention, carbonaceous materials such as bituminous coal, lignite, peat, trash, and/or sewage sludge are introduced into a suitable roaster, such as multi-hearth vertical roaster or fluidized bed roaster (in an non-oxygen athmosphere) whereby the heating temperatures are under strict control at each level and the gases so evolved are removed at various levels or temperature ranges to prevent their further decomposition by over heating. The solid carbonaceous material is heated to a temperature not to exceed 625° C., but normally between 250° and 500° C., in a period not to exceed 3.5 hours but long enough to evolve the majority of the low temperature tars (primary tars) and accompanying light oils or liquors (ammonia). The speed of the rotation of the roaster arms and/or the cold feed is regulated to assure the desired roaster retention time of the carbonaceous materials. The multi-hearth roaster arms are attached with devices to spirally move the solid materials outward (or inward) with a plow-like action as the arms rotate. The heated materials is so moved from the middle or outside of the respective floor or deck area to the respective outside or middle portion and dropped through a cut-away to the next lower level and is redistributed by the roaster arms with the plow action. The next lower level is hotter, thus providing by continuous action the moving of the material from the cold feed at the top of the roaster downward through progressively hotter floors or decks until destructive carbonization is complete. The evolved gases are quickly collected in the presence of steam at each level to prevent decomposition by over-heating. Thus, satisfactory low temperature char and high type primary tar products are obtained as described below.

The roaster is heated by indirect method including electric elements and/or gas firing with gases produced within the plant system and remaining after the primary tars are removed or after the carbonization of the carbonaceous feed material, the reaction of the tar with $H_2$ gas, the sulfur removal from the char, and/or the production of water gas, and/or the carbonization of the char to a coke material. Consistent with reform methods, the gases consumed for heating the roaster or steam production are oxidized in a reduced oxygen atmosphere and subsequently treated with live or superheated steam to produce free $H_2$ and/or used to produce ammonia with a normal carbon monoxide shift (i.e., $CO+H_2O \rightarrow H_2+CO_2$) or used to produce additional synthetic oil or alcohol as described below. The roaster preferably has heat exchange capabilities in the bottom area to capture as much heat as possible from the heated char as it is cooled. The char derived by heating the carbonaceous materials to 600° C. is treated in the bottom area with $H_2$, live steam and/or super heated steam with or without a carbonate acceptor to remove a substantial amount of the remaining sulfur from the hot char. By using steam, a carbon monoxide shift will occur as the char is cooled and free $H_2$ and/or water gas will be evolved. The free $H_2$ is in contact with hot char at least 2 minutes and up to about 120 minutes or until $H_2S/H_2$ equilibrium of about 6 to 7% $H_2S$ is obtained. $H_2S$ equilibrium will be considered to exist when the ratio of $H_2S$ is at a maximum of 7% of the atmosphere next to the hot char particle being affected. $H_2S/H_2$ equilibrium will be avoided by controlling the flow rate of steam and/or free $H_2$ gas and removal of the gases from hot char particle quickly so as to maintain the desired 7% maximum limit. Approximately 65% of the fixed sulfur may be removed from the hot char particles in this manner. If additional sulfur must be removed, the $H_2$ retention time must be extended and the operating pressure increased to as much as 2000 PSI. In addition, carbonaceous industrial waste, municipal waste and/or sewage solids, peat, lignite or other bituminous coals may be blended in the partially carbonized char stream to reduce or eliminate agglomeration and/or to increase the quantity and quality of the low temperature tar and gases derived during the char production.

The exhaust gas resulting from char cool down and/or clean up contains $H_2$, $CO_2$, CO, steam and other trace gases. These exhaust gases may be separated by absorption methods or by other methods known to the industry to separate the $H_2$ and various carbon materials. The $H_2$ is recycled into the plant system for subsequent use.

The gases or water gas derived by treating the char or coke with steam or by treating the char with $H_2$ to remove the sulfur may be cleaned to remove the sulfur containing gases. The remaining or clean gases are reacted with super heated steam or $H_2$ in the presence of iron, nickel, cobalt or manganese catalyst in the form of powder filings, turnings, or pellets which have been treated with a basic salt solution such as potassium hydroxide or calcium hydroxide in a continuous manner in a high pressure reactor. The reactor is heated externally to 300° C. to 450° C. and pressure maintained of from 20 to 150 atm. for from 5 to 12 minutes. The gas preferably has a minimum ratio of approximately 2 parts $H_2$ to 1 part CO to prevent catalyst erosion. The gases exhausted from the catalyst are cooled and produce a synthetic oil and an alcohol precipitate. The cooling water contains a substantial amount of olefins. This water may be treated in a normal manner to remove the olefins or used as is for make up water for the steam to be used for sulfur removal from the char. The oil is transferred to the last tar reactor of the catalytic converter and finished into petroleum products. The alcohol is distilled into products or used in the system and/or converted to petrochemical materials.

If a carbonaceous acceptor is used to remove the sulfur from the char, it is separated from the char by screening or electrostatic precipitation and the sulfur is removed as $SO_2$. The carbonaceous acceptor is then recycled into the hot char and the $SO_2$ is converted to sulfuric acid or used in the system to develop other sulfur products such as fertilizers.

After the hot gases and any sulfur acceptor, if used, have been removed from the roaster, the remaining solid material, a high volatile char, is removed mechanically from the roaster, cooled, and marketed or further processed by heating up to 1100° C. in a slot furnace or with steam and/or hot gases into coke, water gas and/or producer gas which can be used for heat, marketed and/or refined in a light ends plant to produce products such as $C_1$–$C_4$, LPG, BTX, etc., and if available, olefins. A solid coke may be produced from briquettes formed by adding tar, asphaltines, etc. to the finely divided char.

The hot gases evolved during the roasting process are cleaned by liquid spraying or electrostatic precipitation to remove any particles of coal, etc., and returned to the roaster. The gases are then condensed by cooling in a heat exchanger. From the cooled gases a low temperature tar distillate will be produced leaving various gases. The gases remaining are transferred to the light ends plant and separated into products or used as fuel for heat or converted to synthetic oil and alcohol as described above.

The raw primary tar or recycled bottoms are introduced in an as is condition with $H_2$ into the first reactor; however, if the material contains an excessive amount of large hydrocarbons molecules, solids, etc., or asphaltines, it may be necessary to pretreat the tar. This pretreatment may include pre-coking by heating the material to precipitate the asphaltines and/or solids or the material may be dissolved in a solvent naphtha derived from either of the last 2 $H_2$ reactors or treated under pressure with $CO_2$ and $H_2O$ at 30 to 180 atm. and a maximum temperature of 500° C. Sixty percent tar material or bottoms are mixed with a 20 to 80% middle distillate solvent (gas oil or naphtha) and the solids allowed to dissolve or settle out as the case may be. This treatment, if necessary, will prevent undue precipitate build-up in the feed lines and in the catalyst beds. The primary tar is introduced into the reactor with approximately 1200 to 1500 standard cubic feet of $H_2$ takeup for each barrel of low temperature primary tar and/or salvage bottoms and the mixture brought into contact with a catalyst under controlled pressure, heat, and time. An autoclave-type batching unit having a catalyst void ratio of from 1:1 to 4:1 can be advantageously used or a series of continuous flow through units with a liquid hourly space velocity (oil to catalyst volume ratio) of from 1.0 to 5.0 may be used for the reactors. The pressure in the units is to be maintained between 500 and 2000 psi and the temperature between 350° C. to 700° C. Generally, the tars being treated are passed through the primary reactor at a temperature between 350° C. to 370° C. and are then passed through a second reactor at a temperature of 370° C. to 450° C. A third reactor may be desirable at a temperature of 450° C. to 700° C. Intermediate reactors at intermediate temperatures may be used to improve the product quality. The first reactor chamber preferably has a cobalt molybdenum catalyst in a fixed bed and is responsible for removal of a substantial amount of the sulfur from the tar as hydrogen sulfide gas. Depending upon the amount of sulfur remaining in the partially reacted tar, the second reactor chamber is charged with additional $H_2$ over either a coblat-molybdenum catalyst or a nickel catalyst depending upon the amount of aliphatic or aromatic products desired. The third reactor, if used, is charged with any suitable reactive catalyst normal to the oil refining industry. Catalysts in any intermediate reactors are adjusted as appropriate. Additional $H_2$ may be added to the third reactor. A normal high pressure catalytic converter or distillation unit may be used as the third reactor. The resultant effluent from the first two reactors will be high type synthetic crude oil and gases. The resultant effluent from the third reactor or catalytic converter will be high type crude oil from which may be distilled in naphtha rich in aromatics and phenols. Bottoms from the last reactor or from the catalytic converter are recycled back to the inflow at the first or second reactor and additional $H_2$ added to the partially hydrogenated material reacted in the manner of the new feed stock either independently or with the new feed stock. After cooling, the hydrocarbon gases evolved from any and all of the reactions and containing hydrogen sulfide and nitrogen compounds are removed to a light ends plant for separation and further processing into marketable products or processed into synthetic oil or alcohol as described above. $H_2$ gases purged from the tar reactor gases or char sulfur removal gases can be recycled with 90% purity.

Primary tar or gases used in these processess may be augmented with raw crude oil or natural gas if available. The crude may be pre-treated and/or introduced with primary tar into any of the reactors as appropriate. The natural gas may be used as heat and/or feed stock for the synthesis process and/or $H_2$ production and/or separated in the light ends plant. Gases from any other coal or other hydrocarbonization process including sewage disposal may be incorporated into the process as appropriate. Exhaust gases from utility heat processes containing various hydrocarbons and large amounts of CO and $CO_2$ and inorganic gases may be used in the synthesizing process described above and/or separated and used in the light ends plant.

The hydrogen gas can be recycled and introduced into the low temperature tar stream entering the reaction chamber or burned as flare gas or used to remove the sulfur from the hot char. The hydrogen sulphides can be processed to produce a commercial sulfur or processed with hydrogen to produce commercial acids. The light hydrocarbons can further be refined in light end units and the gases evolved may be separated and developed into products. The nitrogen compounds can be converted into commercial fertilizer, acids and other products.

The low temperature tar which has been converted into a synthetic crude stock is then processed in a conventional petroleum distillation unit to yield a naphtha product boiling below 250° C. and a series of gases which are utilized in a light ends plant or burned as excess or converted into oil and alcohol as described above. The synthetic crude, after removal of the naphtha and light end gases, becomes a residual and can be recycled with the primary tars or further treated to form various grades of asphaltic material, fuel oils and lubricating stock.

The material removed from the distillation unit as a naphtha cut can be processed into petroleum products or petrochemicals by utilizing any number of refining processes known in the art. The light ends plant consists of polymerization, alkylation and/or isomerization units. The phenol can be processed in commercial units.

What is claimed is:

1. In a process for preparing an essentially sulfur free synthetic crude oil including the steps of roasting carbonaceous materials at a temperature of about 400° to 600° C. for about two to four hours, continuously collecting and condensing the distillation gases, separating the low temperature tars from the condensed gaseous products contacting the low temperature tars with a first hydrogen carrying catalyst in a fixed bed system heated to a temperature of 300° to 700° C. and a pressure of 500 to 2000 psi in the presence of hydrogen added in an amount of 1200 to 1500 cubic feet of hydrogen per barrel of low temperature tars, cooling the effluent from the reactor and separating the gaseous products therefrom, and recovering the essentially sulfur free synthetic crude oil product, the improvement comprising the derivation of a char comprising the steps of heating said carbonaceous materials up to 600° C., blending into said carbonaceous materials with continuous agitation additional carbonaceous materials selected from the group consisting of carbonaceous industrial waste, municipal waste, sewerage solids, and peat to reduce agglomeration and increase the quantity and quality of the low temperature tars, chars and gases derived during the char production, and treating the char with a gas selected from the group consisting of live steam, super heated steam and $H_2$ for at least two minutes and up to 120 minutes to remove a substantial amount of sulfur from the hot char.

2. The improved process according to claim 1 further comprising the steps of reacting the CO and $CO_2$ containing gases and water gases evolved in said process for preparing synthetic crude oil and deriving said char with a gas selected from the group consisting of super heated steam and $H_2$ in the presence of a second hydrogen carrying catalyst in a high pressure continuous reactor at a temperature of 300° to 450° C. and a pressure of 20 to 150 atm. with a retention time of 5 to 12 minutes, and cooling the gases exhausted from the catalyst to produce a product of oil and alcohol.

3. The improved process according to claim 2 wherein said second hydrogen carrying catalyst is selected from the group consisting of iron, nickel, cobalt and manganese.

4. The improved process according to claim 1 wherein the low temperature tars are fed into a primary reactor maintained at a temperature of 350° to 370° C., then passed through a second reactor at a temperature of 370° to 450° C. and then passed through at least a third reactor at a temperature of 450° to 700° C.

5. The improved process according to claim 4 wherein at least some of the partially hydrogenated bottoms from said third reactor is recycled to one of said primary reactor and said second reactor.

6. The improved process according to claim 1 wherein the primary tars and at least some of the partially hydrogenated bottoms are recycled, the process further comprising the step of adding a 20 to 80% middle distillate solvent from the distillation of the synthetic crude oil and allowing the mixture to settle for up to 72 hours prior to reacting the material thereby reducing the various solids.

7. The improved process according to claim 6 further comprising the step of pre-coking the primary tar or the recycled bottoms at temperatures up to 400° C. to precipitate petroleum-like particles.

8. The improved process according to claim 2 wherein water is used to cool the gases exhausted from the catalyst to produce the oil and alcohol products as a result of which the water contains olefins, the olefin containing water being used to produce super heated steam for reacting with the CO and $CO_2$ containing gases and water gases.

9. The improved process according to claim 1 further comprising adding a carbonate sulfur acceptor to the char.

10. The improved process according to claim 1 further comprising the step of adjusting the gas stream velocity to provide for a $H_2S$ content no greater than 7% next to a hot char particle.

11. The improved process according to claim 1 further comprising the steps of heating the hot char after the substantial removal of sulfur to 1100° C. to produce coke and water gas, and cooling the hot coke produced with steam.

12. The improved process according to claim 2 wherein the CO and $CO_2$-containing gases are augmented by CO and $CO_2$-containing gases from an auxiliary process.

* * * * *